United States Patent [19]

Larson et al.

[11] Patent Number: 4,854,574

[45] Date of Patent: Aug. 8, 1989

[54] INSPIRATOR MUSCLE TRAINER

[75] Inventors: Douglas A. Larson, River Forest, Ill.; Thomas L. Clanton, Worthington, Ohio

[73] Assignee: 501 Healthscan, Inc., Cedar Grove, N.J.

[21] Appl. No.: 168,203

[22] Filed: Mar. 15, 1988

[51] Int. Cl.[4] ..... A63B 23/00; A62B 9/02

[52] U.S. Cl. ..... 272/99; 128/200.24; 128/205.24; 128/207.16

[58] Field of Search ..... 272/99; 128/200.24, 128/205.24, 207.16

[56] References Cited

U.S. PATENT DOCUMENTS

| | | | |
|---|---|---|---|
| 433,418 | 7/1890 | Nutz | 128/205.24 |
| 940,735 | 11/1909 | Schaeffer et al. | 272/99 |
| 1,244,661 | 10/1917 | Teter | 128/205.24 |
| 1,392,700 | 10/1921 | Oyen | 272/99 |
| 2,292,474 | 8/1942 | Paxton | 272/99 |
| 3,298,362 | 1/1967 | Lippitt, Jr. et al. | 272/99 |
| 3,958,565 | 5/1976 | Wright | 272/99 |
| 3,992,004 | 11/1976 | Feron et al. | 272/141 |
| 4,025,070 | 5/1977 | McGill et al. | 272/99 |
| 4,054,134 | 10/1977 | Kritzer | 128/208 |
| 4,062,358 | 12/1977 | Kritzer | 272/99 |
| 4,171,804 | 10/1979 | Thead, Jr. | 272/99 |
| 4,207,884 | 6/1980 | Isaacson | 128/200.24 |
| 4,221,381 | 9/1980 | Ericson | 272/99 |
| 4,226,233 | 10/1980 | Kritzer | 128/205.13 |
| 4,444,202 | 4/1984 | Rubin et al. | 272/99 |

*Primary Examiner*—Richard J. Apley
*Assistant Examiner*—J. Welsh
*Attorney, Agent, or Firm*—Wolder, Gross & Yavner

[57] ABSTRACT

A pulmonary muscle trainer consisting of a tubular body having a poppet valve dividing the body into two sections. The poppet is adjustably biased into the closed position, whereby inspiration of a given intensity will be sufficient to overcome the bias and allow air flow through the unit. The poppet is supplied with a one-way valve element to permit the user to create an unrestricted expiration air flow to allow a breathing rhythm to be established. In a preferred embodiment bias is maintained on the poppet by a spring whose compression is adjustable by means of a collar manually positionable within the body of the unit. By the use of the poppet a constant threshold pressure load may be applied.

16 Claims, 2 Drawing Sheets

INSPIRATOR MUSCLE TRAINER

The present invention relates to a pulmonary training device and, in particular, to a new and improved pulmonary training device which allows the stress placed upon the pulmonary muscles to be adjusted as required for the training and exercise level of the individual.

Many persons suffer from ailments in which ventilatory muscle function has been impaired. The respiratory muscles, like other body muscles, respond to resistive training, and accordingly can be exercised to increase strength and endurance.

There have been several approaches taken to provide such pulmonary training devices. Typical of such devices is the air flow rate incentive inspirometer. Devices of this type visually indicate the inspiratory flow rate and/or volume, and are intended to provide a visual incentive to the user to increase the flow rate or volume of air inspired. In general, however, devices of this type fail to provide a significant restriction or resistance to breathing, and accordingly do not significantly develop respiratory muscle strength or endurance.

Another methodology utilized by the prior art is embodied in the fixed orifice restrictor. Devices of this type utilize a fixed orifice to restrict air flow during inspiration. Such devices require the user to increase the load on the pulmonary muscles in order to inspire at a given flow rate through the device. In such a device, the resistive load is proportional to the square of the flow rate. This relationship makes it difficult for the user's training level to be monitored and for progress to be accurately charted.

It is therefore a purpose of the present invention to provide an inspiratory expiratory muscle training or exercise device which provides a constant threshold pressure load.

A further purpose of the present invention is to provide such a training device which allows for simple adjustment of the applied load.

Yet a further purpose of the present invention is to provide such a training device which is economical to manufacture and the use of which may be easily learned by the user.

In accordance with the above and other purposes and objects, the present invention is comprised of an elongated tubular body or housing having a first end adapted for connection with a mouthpiece and a second end open to the ambient atmosphere connected by a longitudinal passageway. A poppet valve is seated within the passageway and provides a normally-engaged barrier for the passage of air from the atmosphere into the pulmonary system of the user. Bias means are provided to restrain the poppet valve closed until a threshold force is created by the inspiration of the user, the bias means thereby creating a workload to exercise the pulmonary muscles. A one-way valve means is further provided within the housing sections to allow the free passage of air across the poppet barrier into the atmosphere when the user expires. At the conclusion of the expiration cycle, the valve closes, re-establishing the poppet barrier, whereby the load upon the inspiration of the user is re-established.

In a preferred embodiment of the invention, the bias means is in the form of a spring, the compression of the spring being adjustable to allow modification of the inspiratory workload. The spring may be located between the poppet and a collar, the collar being movable along a threaded shaft to vary the distance between the collar and poppet and hence the spring force.

The housing for the unit may advantageously be constructed of two releasably secured members, which may be disassembled to facilitate cleaning and repair. In such an embodiment, the bias spring and other internal parts are also readily accessible for replacement and cleaning.

A more complete understanding of the present invention will be achieved upon consideration of the following detailed description of a preferred, but nonetheless illustrative, embodiment of the present invention when taken in conjunction with the annexed drawings, wherein.

Referring to the figures, inspiratory muscle training device 10 may be constructed of first and second tubular body pieces 12 and 14, joined together to form an internal passageway 16 through the device terminating in open ends 18 and 20.

Figure 2:
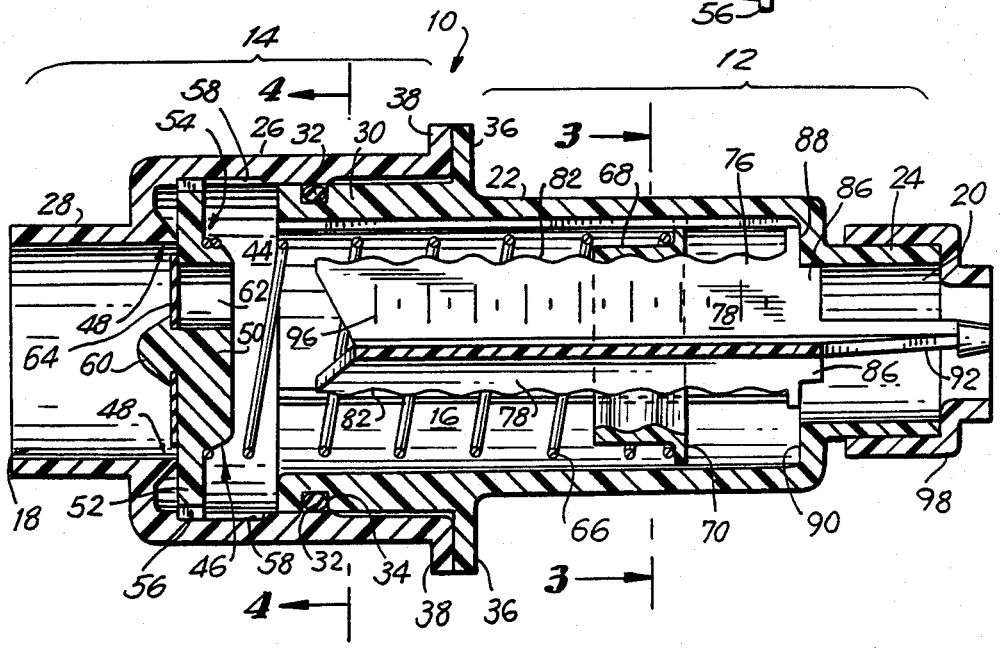
FIG. 2 is a longitudinal sectional view of the device taken along line 2—2 of FIG. 1.

As may be best seen in FIG. 2, first body piece 12 includes a main cylindrical portion 22 of a first inner diameter coupled to a mouthpiece-accepting portion 24 of reduced diameter having open end 20. Second body piece 14 is adapted to interfit with body piece 12, has main cylindrical portion 26 coupled to a reduced diameter neck portion.

Figure 1:
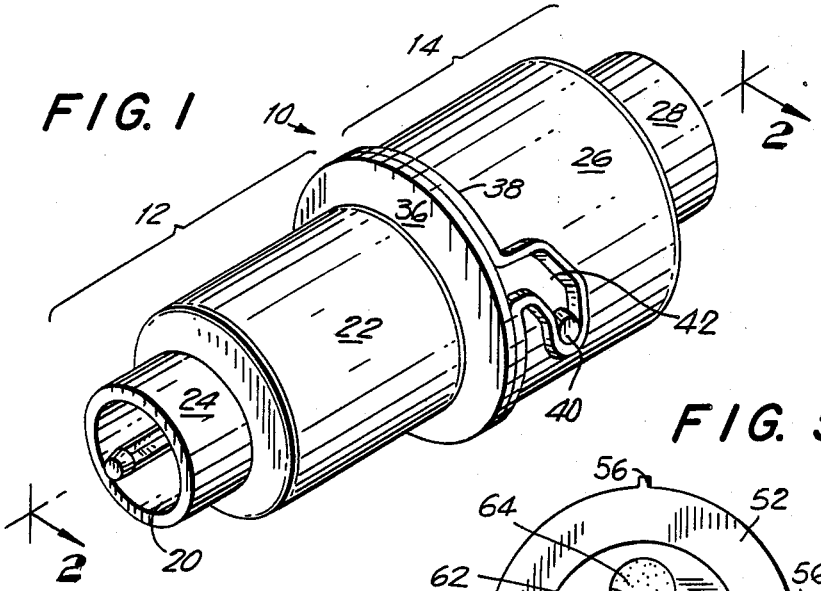
FIG. 1 is an isometric view of the invention.
Figure 4:
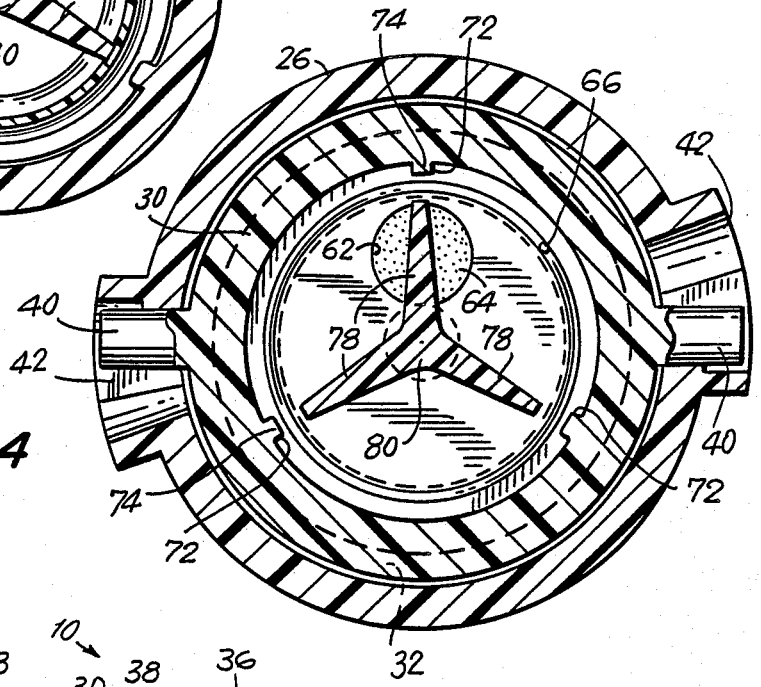
FIG. 4 is a second transverse sectional view taken along line 4—4 of FIG. 2.

Main portion 22 of first body piece 12 may be provided with a section 30 of increased wall thickness. The inner diameter of second body piece portion 26 is chosen to allow the two body pieces 12 and 14 to interfit together, with O-ring seal 32 being mounted on circumferential groove 34 on section 30 to insure an air-tight connection. Annular shoulder 36 is provided at the transition point between thickened wall section 30 and the abutting portion of second body piece 14, and abuts against mating annular shoulder 38 located at the end of second body piece 14. As may be seen in FIGS. 1 and 4, thickened wall section 30 may be provided with a pair of radially extending knobs 40, while body piece 14 is provided with a pair of angled and shouldered keyways 42 to permit a locking function between the two body pieces to be accomplished upon mating. The body piece 12 and 14 may be fabricated of an appropriate material, such as acrylic.

The mating of pieces 12 and 14 creates a generally cylindrical volume 44 within second body piece 14, the diameter of this volume being greater than that of either body portion 22 or neck portion 28. Mounted within cylindrical volume 44 is poppet 46. Poppet 46 abuts against inner annular lip 48 formed in body piece 14, and creates an air-tight barrier in passageway 16 between volume 44 and open end 18.

Figure 5:
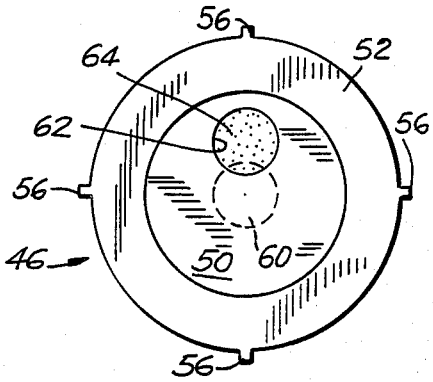
FIG. 5 is a plan view of the poppet valve as seen from the right side of FIG. 2.

Poppet 46 may be formed of any appropriate material, such as acrylic, and includes a central circular hub portion 50 and a radially extending circular arm portion 52, the intersection of the hub and arm defining a circumferential shoulder 54. Circular arm portion 52 provides a sliding non-air-tight fit within cylindrical volume 44 and, as best seen in FIG. 5, may be provided with a plurality of projections 56 which mate with corresponding longitudinal grooves or recesses 58 in the interior surface of body piece 14 as seen in FIG. 2, to maintain alignment of the poppet. Hub 50 is provided with integral outwardly-facing stud 60 and through passageway 62. A silicone rubber flapper 64 is mounted on stud 60 and serves as a one-way valve element, allowing air to pass from the right side interior of passageway 16 as seen in FIGS. 2 and 5 outward through open end 18, but preventing the flow of air in the opposite direction.

Figure 3:
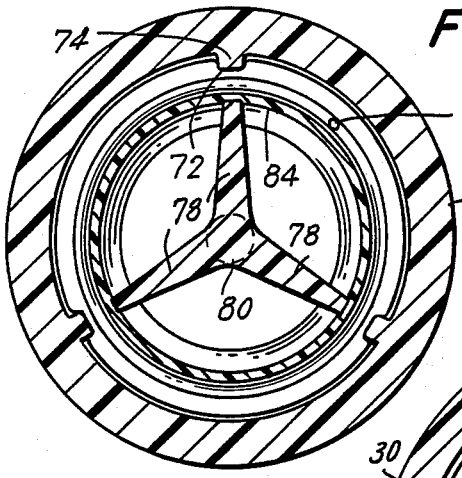
FIG. 3 is a transverse sectional view taken along line 3—3 of FIG. 2.

As best seen in FIG. 2, poppet 46 is normally biased against annular internal lip 48 by coil spring 66, whose diameter is such to allow an end thereof to rest upon poppet shoulder 54. The opposite end of spring 66 is supported on polypropylene collar 68, which may be variably positioned along the length of body portion 22 to adjust the compression of spring 66 and accordingly the force exerted by spring 66 against poppet 46. Collar 68 is in the form of a stepped or shouldered cylinder, the larger diameter peripheral step portion 70 being provided with three equidistantly located notches 72 as seen in FIG. 3. These notches 72 engage with longitudinally extending ribs 74 located on the inner wall of body portion 22.

Collar 68 is fixed in longitudinal position by polypropylene tri-armed shaft 76 extending longitudinally within main portion 22. Each of the three arms 78 are mounted to a central hub portion 80. The outwardly directed longitudinally extending surfaces of arms 78 are each provided with coarse threads 82, which mate with a corresponding set of threads formed on the inner surface 84 of collar 68. The ends 86 of arms 78 are provided with three foot-like bearing surfaces 88, which bear against inner transverse cylindrical surface 90 formed at the intersection of mouthpiece-accepting portion 24 and main section 22. A rod portion 92 of shaft 76 extends outwardly from open end 20 and may be provided with knob portion 94.

In operation, the position of collar 68 may be adjusted by rotation of knob 94. As threaded shaft 76 is rotated, the threads on arms 78 engage with the corresponding threads on collar 68 and, as collar 68 is prevented from rotation by the interfit of notches 72 with ribs 74, collar 68 travels transversely within body portion 22. Spring 66, which is mounted between collar 68 and poppet 46, is thus tensioned as desired. The arms 78 may include calibration marks 96 which, when aligned with a reference point or surface on collar 68, provide an indication of spring compression.

In particular, a threshold pressure of from 5–35 centimeters of water provides an appropriate exercise range. To achieve this pressure range a spring of 0.031 in diameter stainless steel having a full length of 3 inches and 6 one inch turns has been found appropriate.

Figure 6:
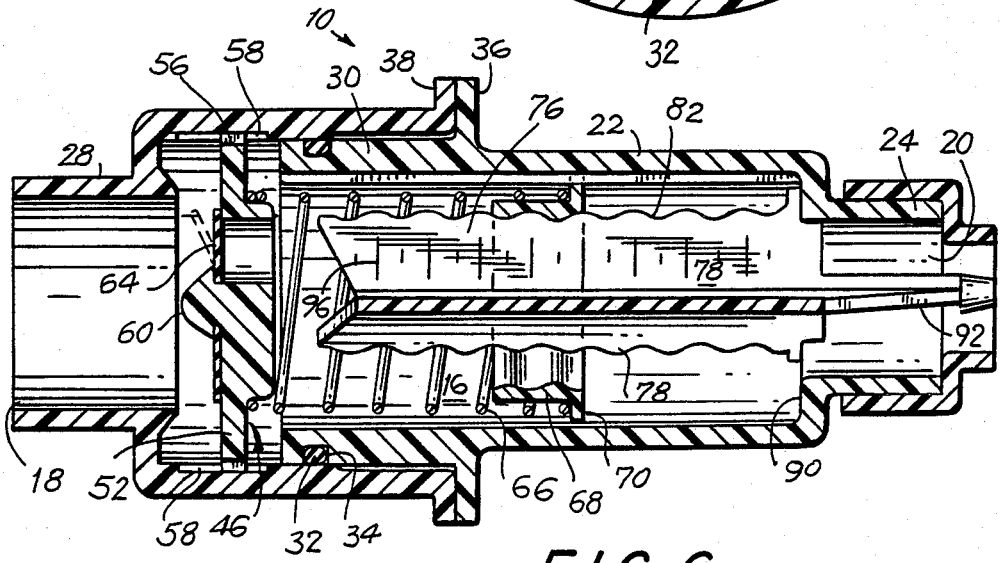
FIG. 6 is a longitudinal sectional view taken along line 2—2 of FIG. 1, illustrating the device in use.

With spring tension set, removable mouthpiece 98 is placed on mouthpiece-accepting portion 24, the mouthpiece being held by the lips of the user, and inspiration attempted. A resistive force is created against the reduced pressure atmosphere within passageway 16 and volume 44 created by the user's inspiration, the resistive force being exerted upon poppet 46 by spring 66. As this resistive force is overcome, poppet 46 is drawn to the right, as shown in FIG. 6, allowing ambient air to pass into passageway 16 around the edges of the poppet. As the displacement to the right, as seen in FIG. 6, is minimal before air flow commences, the inspiratory force necessary to overcome the spring bias is essentially constant, irrespective of inspiration flow rate. A constant load is thereby achieved on the pulmonary muscles. When inspiration ceases, poppet 46 is returned to its normal, far left position as shown in FIG. 2, again sealing against lip 48. Upon expiration, flapper 64 is drawn away from passageway 62, allowing the expired air to pass out into the ambient atmosphere through open end 18. It is to be recognized that expiratory muscle tone may be worked by using neck portion 28 as a mouthpiece-accepting portion, whereby expiration is against the force of spring 66.

By appropriate adjustment of the compression of spring 66, coupled with a proper exercise regimen, the pulmonary muscles may be exercised, thus allowing pulmonary function and endurance to be improved.

We claim:

1. A lung/diaphragm exerciser device comprising a tubular body defining a chamber having open first and second opposed ends therein, movable sealing means mounted within said chamber for movement between a first position restricting the passage of air from said second end to said first end and a second position whereby said restriction is removed; bias means mounted within said chamber to resist motion of said sealing means from said first position to said second position, and valve means mounted within said chamber allowing the free passage of air from said first end to said second end while prohibiting the passage of air from said second end to said first end.

2. The unit of claim 1, wherein said sealing means is in the form of a poppet.

3. The unit of claim 2, wherein said valve means is mounted on said poppet.

4. The unit of claim 3 further including means to maintain said poppet in alignment during movement between said first and second positions.

5. The unit of claim 4, wherein said maintenance means includes a plurality of longitudinal grooves on the interior surface of said chamber and a plurality of radial projections on said poppet adapted to fit and slide within said longitudinal grooves.

6. The unit of claim 1, wherein said bias means is adjustable.

7. The unit of claim 6, wherein said bias means includes a spring.

8. The unit of claim 7, wherein said bias means further includes track means mounted in said chamber and a collar riding on said track means, said spring being mounted between said collar and said poppet, said collar being positionable along said track means.

9. The unit of claim 8, wherein said bias means comprises a threaded post mounted coaxially with and within said tubular body, said collar being threaded on said post.

10. The unit of claim 9, wherein said threaded post includes three threaded arms extending along the length of said post, said collar being mounted on said arms.

11. A pulmonary exerciser comprising a tubular body having a mouthpiece-accepting end, an exit port end and a medial portion therebetween; a poppet mounted in said medial portion, said poppet separating said exit port end from said mouthpiece-accepting end; a one-way valve mounted on said poppet to allow an increased pressure differential on the mouthpiece-accepting side of the poppet to be dissipated through said exit port; a spring located within said body and located between said poppet and a collar to bias said poppet in a direction away from said mouthpiece-accepting end into a sealing relationship with said medial portion, said collar being mounted for longitudinal positioning within said body and having alignment means mateable with alignment means located along the inner wall of a portion of said body and having a central bore therethrough; and a threaded shaft coaxial with said body journaled for rotation therein and extending through said threaded bore whereby said collar may be selectively positioned within said body.

12. The device of claim 11, wherein said collar alignment means includes at least one notch in the periphery of said collar and said wall alignment means includes at least one longitudinal rail.

13. The device of claim 12, wherein said threaded shaft includes a handle section extending through said mouthpiece-accepting end.

14. The device of claim 13, wherein said threaded shaft further comprises a plurality of thread-bearing arms mounted to a central hub.

15. The device of claim 11, wherein said one-way valve comprises a rubber flap located over a passageway through said poppet.

16. The device of claim 11, wherein said medial portion includes an internal annular lip adapted to engage said poppet to form said sealing relationship.

* * * * *